United States Patent [19]

Zeiffer

[11] Patent Number: 4,655,056

[45] Date of Patent: Apr. 7, 1987

[54] FOAMED TREATING LIQUOR APPLICATOR

[75] Inventor: Dieter F. Zeiffer, Iron Station, N.C.

[73] Assignee: Gaston County Dyeing Machine Co., Stanley, N.C.

[21] Appl. No.: 743,488

[22] Filed: Jun. 11, 1985

[51] Int. Cl.[4] ..... D06B 1/04

[52] U.S. Cl. ..... 68/205 R; 118/410; 118/415

[58] Field of Search ..... 68/200, 205 R; 118/410, 118/411, 412, 415

[56] References Cited

U.S. PATENT DOCUMENTS

| | | | |
|---|---|---|---|
| 4,074,625 | 2/1978 | Mitter | 68/200 X |
| 4,398,665 | 8/1983 | Bryant et al. | 68/205 R X |
| 4,402,200 | 9/1983 | Clifford et al. | 68/200 |

FOREIGN PATENT DOCUMENTS

| | | | |
|---|---|---|---|
| 95085 | 5/1983 | European Pat. Off. | 68/200 |
| 2309300 | 9/1973 | Fed. Rep. of Germany | 68/200 |
| 2365079 | 7/1975 | Fed. Rep. of Germany | 68/200 |
| 937569 | 6/1982 | U.S.S.R. | 68/200 |

*Primary Examiner*—Harvey C. Hornsby
*Assistant Examiner*—Frankie L. Stinson
*Attorney, Agent, or Firm*—Shefte, Pinckney & Sawyer

[57] ABSTRACT

An applicator for applying foamed treating liquor across the flat width of a traveling textile fabric or like substrate includes an arcuate housing having an arcuate interior partition wall intermediate a foam inlet port and a foam emission nozzle opening in the housing to define a distribution chamber providing a turning foam pathway from the inlet port about the curved edge of the partition wall to the emission opening. The curved edge of the interior wall is parabolic in shape to define substantially all possible foam flow paths from the inlet port linearly to the curved edge and linearly the respective shortest distances therefrom to the emission opening to be of substantially the same total length. Accordingly, foam residence time within the distribution chamber is substantially constant regardless of the flow path assumed, to control foam degeneration to occur uniformly for uniform widthwise treatment of the traveling fabric.

16 Claims, 5 Drawing Figures

S
10
16
14
25
12
16
26
20
50
28
34
18
30

130
38
132
28
28'
18
32'
42"
44
4
4
38
130

FOAMED TREATING LIQUOR APPLICATOR

BACKGROUND OF THE INVENTION

The present invention relates generally to apparatus for applying foamed treating liquor across the width of a traveling substrate such as textile fabric or the like.

The finishing of textile fabrics or like substrates typically includes the application of dye or other treating liquor. In the past, various methods and apparatus employed for this purpose provided for the passage of the traveling dry fabric or substrate through an immersion bath of the treating liquor, by which the fabric took on a significant amount of the treating liquor. The excess liquor absorbed or adsorbed by the fabric, of course, required removal, usually through heat-induced drying of the fabric or substrate.

With the significant increases of energy costs over recent years, there has arisen an increasing concern for reducing the energy costs associated with textile finishing operations. As one means of accomplishing this objective, various methods of applying treating liquor to fabric have been proposed as alternatives to the immersion methods so as to minimize the necessity and resultant energy costs associated with drying of wet treated fabrics. One particularly successful and now widely used alternative technique involves the application of the treating liquor in a foamed condition so that the amount of so-called "wet pick-up" by the fabric being treated is maintained relatively low and, in turn, a minimal amount of fabric drying is required to remove the correspondingly low amount of excess treating liquor.

Present conventional apparatus for applying foamed treating liquor utilize a distribution chamber to distribute transversely the foamed treating liquor received from an input tube or similar conduit and to deliver the distributed foam to an elongate nozzle which extends transversely across the width of the traveling fabric or substrate to dispense thereon the foamed liquor. Effective prior apparatus for this purpose are disclosed in U.S. Pat. Nos. 4,237,818 and 4,402,200, commonly owned with the present invention. Specifically, U.S. Pat. No. 4,237,818 discloses an upstanding distribution chamber which flares transversely from a central collection section as the chamber extends vertically to apply the foamed treating liquor to the bottom surface of a traveling substrate. U.S. Pat. No. 4,402,200 discloses a flared distribution chamber circumferentially mounted on a cylindrical supporting member to achieve the desired transverse foam distribution while applying foamed liquor from above the substrate.

In each such prior applicator, the flared nature of the distribution chamber necessarily causes the foamed treating liquor to travel a greater distance from the inlet tube to the transverse ends of the nozzle than to the central area of the nozzle. It is recognized in the relevant art that foamed treating liquor degenerates quickly from its foamed state into its previous liquid state. Accordingly, these flared distribution chambers cause the foam emitted from the nozzles to be in varying states of foam degeneration along the length of the nozzle which can produce undesired side-to-side variations in the wet pick-up by the substrate or fabric of the liquor and, in turn, in the treating effect and appearance of the substrate. This problem is especially acute with distribution chambers having considerable height and width as may be required for substrates of substantial widths.

SUMMARY OF THE INVENTION

Accordingly, it is a principal object of the present invention to provide an apparatus for applying foamed treating liquor across the width of a traveling substrate which controls the degeneration of the foamed liquor to occur uniformly along the length and width of the distribution chamber to achieve the most uniform possible treatment of the fabric.

Briefly described, the apparatus of the present invention includes a housing having a foam inlet port formed therein for communication with a source of foamed treating liquor, an elongated emission opening formed in the housing for disposition across the width of the substrate for applying the foamed treating liquor thereto, and a foam distribution chamber defined within the housing for providing communication between the inlet port and the emission opening for delivering the foamed treating liquor to the full elongate extent of the emission opening. The inlet port is of a reduced dimension relative to the longitudinal dimension of the emission opening. The distribution chamber is accordingly configured for defining a plurality of foam flow paths of substantially equivalent length from the inlet port to the emission opening for controlling foam degeneration of the foamed treating liquor to occur uniformly along the length and across the width of the distribution chamber for uniform treatment of the substrate across the width thereof.

In the preferred embodiment of the present invention, a partition is disposed within the distribution chamber intermediate the inlet port and the emission opening for defining a turning foam flow pathway from the inlet port to the emission opening. An interior wall within the distribution chamber forms the partition and has a curved edge centered about the inlet port and extending substantially normal to the emission opening to define the foam pathway about the curved edge. The curved edge of the interior wall is of a curvature defining substantially all possible foam flow paths about the curved edge diverging from the inlet port linearly to the curved edge and linearly the respective shortest distances therefrom to the emission opening to be of substantially the same total length. Specifically, the curved edge of the interior wall is defined by points located according to the formula $L/2=c+b$, where "L" represents the length of a chord of the interior wall subtending the curved edge parallel to the emission opening and perpendicularly intersecting the axis of the inlet port at the center point of the chord; "c" represents the linear distance of each point from the center point of the chord, and "b" represents the linear distance of each point perpendicularly from the chord. Stated differently, the points defining the curved edge are located according to the formula $b=(L/4)-(a^2/L)$, where "a" represents the distance coordinate of each point measured along the chord from the center point of the chord; and, "b" represents the distance coordinate of each point perpendicularly from the coordinate "a." The length "L" of the chord of the interior wall is approximately the elongate extent of the emission opening which is substantially equal to the width of the substrate.

The housing includes a pair of side walls disposed on opposite sides of the interior wall in parallel relation therewith, each side wall having a curved edge extending adjacent and substantially coextensively and correspondingly with the curved edge of the interior wall, and a curved end wall compatibly curved with the curved edges of the side walls and extending transversely therebetween. In this manner, the foam pathway through the distribution chamber is defined to have a substantially constant cross-sectional dimension from the inlet port to the emission opening. The housing also includes an intersection with the interior wall extending along the chord thereof to prevent the foamed treating liquor entering the distribution chamber through the inlet port from flowing away from the curved edge of the interior wall. The housing also includes an applicator nozzle portion defining the emission opening as a linear slot.

DESCRIPTION OF THE PREFERRED EMBODIMENT

Figure 1:
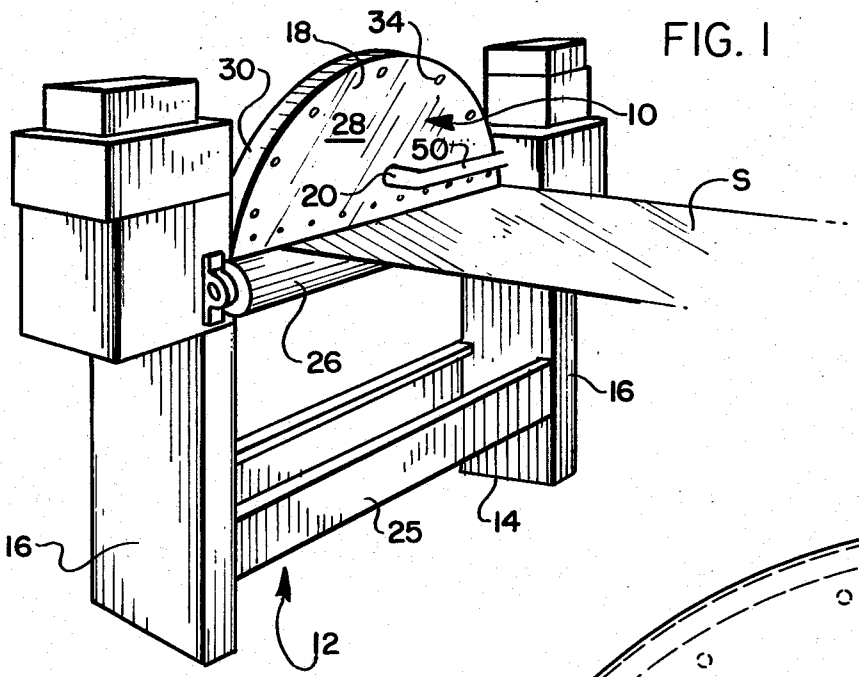
FIG. 1 is a perspective view of a preferred embodiment of the apparatus for applying foamed treating liquor according to the present invention.
Figure 2:
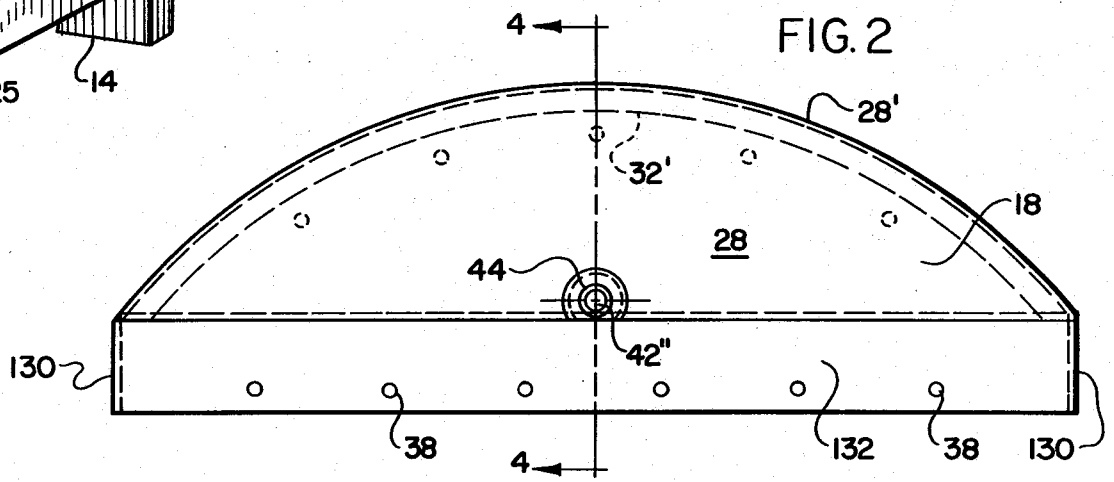
FIG. 2 is a front elevational view of the foam applicator of FIG. 1.

Referring now to the accompanying drawings and initially to FIG. 1 thereof, the foamed treating liquor applicator of the present invention is shown generally at 10 as preferably incorporated in a free-standing apparatus 12 for arrangement in a textile fabric treating range through which a textile fabric travels as a flat width of traveling substrate S.

Basically, the apparatus 12 has a suitable floor-supported frame 14 which includes a pair of opposed end frame members 16 spaced in parallel upright relation sufficiently to permit the substrate S to pass therebetween. The applicator 10 is welded or otherwise affixed to the end frame members 16 to extend transversely between the top portions thereof in disposition above the path of the traveling substrate S. The applicator 10 basically includes a housing 18 having a foam inlet portion 20 at one side thereof, an applicator nozzle portion 22 along the bottom of the housing 18, and an interior distribution chamber 24 (FIGS. 4,5) providing fluid communication between the inlet and nozzle portions 20,22. A pair of idler rolls 26 are mounted at opposite sides of the end frame members 16 to extend transversely therebetween adjacent the nozzle portion 22 of the applicator 10 to support and hold the substrate S against the nozzle portion 22. An open-top tub 25 extends tranversely between the lower portions of the end frame members 16 in disposition below the applicator 10 to catch and retain any excess foamed treating liquor from the applicator 10 which is not taken up by the substrate S.

Referring now to FIGS. 2–5, the applicator housing 18 includes a pair of flat side walls 28,29 vertically arranged in parallel facing relationship to extend substantially the full width of the apparatus 12 between the end frame members 16. The side walls 28,29 have corresponding parallel arcuate upper edges 28',29' joined by a correspondingly arcuate upper end wall 30 which extends transversely between the curved edges 28',29' of the side walls 28,29. An intermediate partition wall 32 is supported equidistantly between the side walls 28,29 by support rods 34 welded to and extending through and oppositely from the partition wall 32 and welded to each side wall 28,29. The partition wall 32 has a comparably curved edge 32' of slightly smaller dimension than the curved edges 28',29 and the curved end wall 30 to be spaced from the end wall 30 a distance substantially equal to the spacing of the partition wall 32 from the side walls 28,29. The side wall 29 and the interior partition wall 32 each have rectangle extension portions 129,132 subtending and extending away from their respective curved edges 29',32', and the end wall 30 has linear extension portions 130 at its opposite ends which extend transversely between the extension portions 129,132 to form the nozzle portion 22 and to define thereby an elongate slotted emission opening 36. To further support the interior partition wall 32, another set of support rods 38 extend between and are welded to the extension portions 129,132 of the side wall 29 and the partition wall 32 and a linear flat bottom end wall 40 extends in parallel relation to the nozzle portion 22 perpendicularly from the partition wall 32 at an intersection 43 therewith subtending its curved edge 32' to the bottom edge of the side wall 28 subtending its curved edge 28'.

The foam inlet portion 20 includes an inlet port 42 of a relatively small dimension and area in relation to the elongate emission opening 36 of the nozzle portion 22. The inlet port 42 is formed centrally in the side wall 28 immediately adjacent and equidistant the ends of the end wall 40 to open into the distribution chamber 24 centrally of the curved portion of the interior partition wall 32. A tubular inlet nipple 44 is fixed to the side wall 28 about the inlet port 42 in communication therewith.

Figure 4:
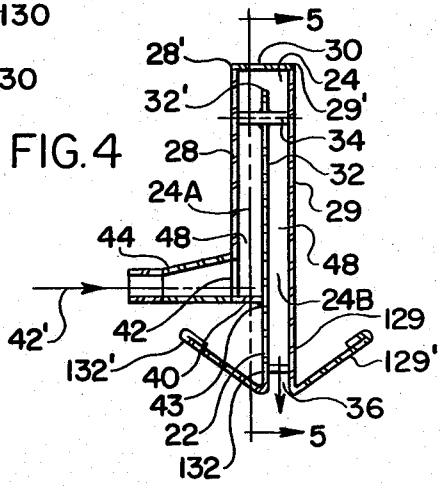
FIG. 4 is a vertical sectional view of the foam applicator of FIG. 1 taken along line 4—4 of FIG. 2.
Figure 3:
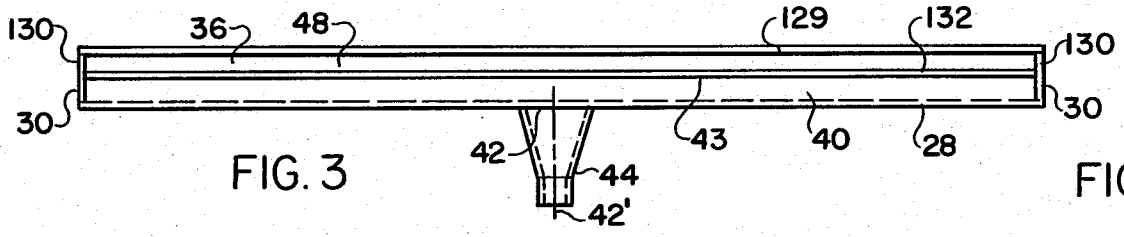
FIG. 3 is a bottom plan view of the foam applicator of FIG. 1.
Figure 5:
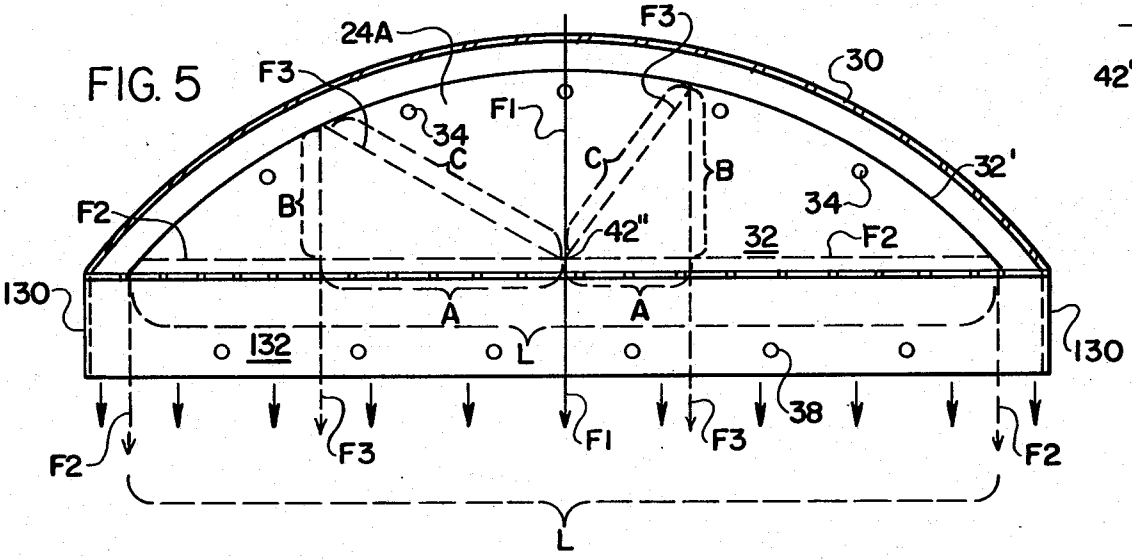
FIG. 5 is another vertical sectional view of the foam applicator of FIG. 1 taken along line 5—5 of FIG. 4.

The inlet nipple 44 affords appropriate connection through a tubular conduit 50 (FIG. 1) communicating with a suitable source of foamed treating liquor prepared in a conventional manner, for admitting and delivering the foamed treating liquor into the distribution chamber 24. The distribution chamber 24 provides a reversely turning flow pathway 48 for equally distributing the foamed treating liquor divergingly from the inlet port 42 upwardly and outwardly within the subchamber area 24A between the partition wall 32 and the side wall 28, about the curved edge 32' of the partition wall 32 through the space between it and the curved end wall 30, and vertically downwardly through the subchamber area 24B between the partition wall 32 and the side wall 29 to the nozzle portion 22 and outwardly through the emission opening 36 therein. The emission opening 36 of the nozzle portion 22 is disposed adjacent and tranversely across the path of the substrate S to apply the emitted foam treating liquor thereto transversely across the flat width of the traveling substrate S. The tautness of the traveling substrate S, in conjunction with the idler rolls 26, holds the substrate S against the nozzle portion 22 at the emission opening 36. The extension portions 129,132 of the side wall 29 and the partition wall 32 are preferably flanged and revesely flared at 129',132' as shown in FIG. 4, to provide smooth contact surfaces for the substrate S to travel across in the vicinity of the emission opening 36 to receive the foamed treating liquor. Alternatively, the extension portions 129,132 may be straight with a pair of nozzle blocks affixed thereto in the manner described and illustrated in commonly-assigned U.S. Pat. No. 4,402,200, to provide similar substrate contact surfaces.

According to the present invention, the curved nature of the distribution chamber 24, and particularly the curved nature of the partition wall 32, are adapted to cause the foamed treating liquor entering the chamber 24 through the inlet port 42 to travel the same distance from the inlet port 42 to the emission opening 36 whether the foamed liquor follows a flow path F1 vertically upwardly and downwardly about the central area of the curved edge 32' of the partition wall 32 or a flow path F2 horizontally about the lateral-most portions of the curved edge 32' of the partition wall 32 or any intermediate flow path F3 about the curved edge 32' of the partition wall 32. For this purpose, the curved edge 32' of the partition wall 32 is formed to a particular parabolic shape defined in relation to the axis 42' of the inlet port 42 by points determined as coordinates from the point 42'' of intersection of the axis 42' with the partition wall 32 according to the formula $L/2=c+b$, where "L" represents the length of the chord indicated at L in FIG. 5 subtending the curved edge 32' in parallel relation to the emission opening 36, the center point of which chord L constitutes the point of intersection 42'' of the inlet port axis 42' with the partition wall 32, where "c" represents the linear distance indicated at "c" in FIG. 5 of each point of the curved edge 32' measured in any direction from the center point 42'' of the chord L to the curved edge 32', and where "b" represents the linear distance indicated at "b" in FIG. 5 of each point of the curved edge 32' measured perpendicularly from the chord L. Stated differently, the points defining the curved edge 32' are located according to the formula, $b=(L/4)-(a^2/L)$, where "a" represents the distance coordinate indicated at "a" in FIG. 5 of each point of the curved edge 32' measured in either direction along the chord L from the center point 42'' of the chord L, and where "b" represents the distance coordinate indicated at "b" in FIG. 5 of each point on the curved edge 32' of the partition wall measured perpendicularly from the coordinate "a" on the chord L.

It is assumed that the foamed treating liquor entering the inlet port 42 flows linearly in an infinite number of diverging flow paths "c" in flowing within the subchamber area 24A from the port 42 to and about the curved edge 32' and therefrom within the subchamber area 24B the shortest respective linear paths indicated at "b" toward the emission opening 36, i.e. perpendicularly thereto. Thus, each respective set of flow paths "c" and "b" form a right triangle with the corresponding segment of the chord L represented at "a," except for the possible paths of the foam linearly along the path F1 to the center of the curved edge 32' and the path F2 along the chord L to the outer ends of the curved edge 32'. According to the Pythagorean theorem, the sum of the squares of the perpendicular sides of a right triangle is equal to the square of the hypotenuse thereof, expressed in relation to the aforementioned right triangle by the formula $c^2=a^2+b^2$. According to the present invention, the sum of the flow path portions "b" and "c" of each possible foam flow path through the distribution chamber 24 is to be a constant value which must, in turn, equal one-half of the length of the chord L, i.e., the distance the foam will travel in the possible path F2 extending linearly along the chord L to the outer ends of the curved edge 32', this basic aspect of the curvature of the edge 32' being expressed by the above-noted formula $L/2=c+b$. *By algebraically solving the Pythagorem formula,* $a^2+b^2=c^2$ and the formula, $L/2=b+c$ for the variable "b," the above-noted formula $b=(L/4)-(a^2/L)$, is obtained for calculating the coordinates "a" and "b" of each point on the curved edge 32' of the partition wall 32 for any given length "L" of the partition wall 32 so as to insure that the total linear distance, b+c, of each possible path the foamed treating liquor may take through the distribution chamber 24 from the inlet port 42 to the location of the chord L within the subchamber area 24B is substantially constant. In this regard, it is also to be noted that the emission opening 36 of the nozzle portion 22 extends substantially normal to the curved edge 32' and, specifically, is parallel to the chord L. Thus, the distance traveled by the foamed treating liquor from each possible foam flow path F1,F2,F3 from the location of the chord L in the subchamber area 24B to the emission opening 36 is also constant. Therefore, the total distance traveled by the foamed treating liquor from the inlet port 42 to the emission opening 36 is substantially equivalent for each possible foam path F1,F2,F3, assuming linear foam travel within the distribution chamber 24 as above-indicated.

As a result, the present applicator 10 causes all of the foamed treating liquor flowing therethrough to have a substantially constant residence time within the applicator 10. Thus, the natural tendency of the foamed treating liquor to degenerate back to a liquid state will occur uniformly across the width of the distribution chamber, i.e., in the direction of the chord L, and along the length of the distribution chamber, i.e., in the directions of the various possible flow paths F1,F2,F3 transversely to the chord L, so that all of the foamed treating liquor emitted through the emission opening 36 of the nozzle portion 22 will have degenerated, if any, to substantially the same extent. The resultant uniformity of the foamed treating liquor produces a correspondingly uniform treatment of the substrate S with very little side-to-side variation in the wet pick-up by the substrate S of the liquor or in the treating effect of the liquor on the substrate S and the resultant appearance thereof. The turning pathway 48 through the distribution chamber 24 provided by the present invention also produces a more vertically compact applicator unit than that of either of the aforementioned U.S. Pat. Nos. 4,237,818 and 4,402,200 and also readily facilitates the use of the present applicator for applying foamed treating liquor from either above or below a traveling substrate S with substantially comparable results.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for applying foamed treating liquor across the width of a traveling substrate comprising a housing having a foam inlet port foamed therein for communication with a source of said foamed treating liquor, an elongated emission opening formed in said housing for disposition across the width of said substrate for applying said foamed treating liquor thereto, a foam distribution chamber defined within said housing for providing communication between said inlet port and said emission opening for delivering said foamed treating liquor to the full elongate extent of said emission opening, said inlet port being of a reduced dimension relative to the longitudinal dimension of said emission opening, partition means disposed in said distribution chamber intermediate said inlet port and said emission opening and including an interior wall in said distribution chamber having a curved edge centered about said inlet port and extending substantially normal to said emission opening to define a turning foam pathway from said inlet port to said emission opening about said curved edge for flow of said foamed treating liquor in a plurality of flow paths of substantially uniform length from said inlet port to said emission opening to cause travel of substantially all of the foamed treating liquor substantially the same distance from said foam inlet port to said elongated emission opening during a substantially uniform residence time in said distribution chamber, thereby causing foam degeneration of said foamed treating liquor to occur uniformly along the length and across the width of said distribution chamber for uniform treatment of said substrate across the width thereof.

2. Apparatus for applying foamed treating liquor across the width of a traveling substrate according to claim 1 and characterized further in that said curved edge is of a curvature defining substantially all possible foam flow paths about said curved edge diverging from said inlet port linearly to said curved edge and linearly the respective shortest distances therefrom to said emission opening to be of substantially the same total length.

3. Apparatus for applying foamed treating liquor across the width of a traveling substrate according to claim 2 and characterized further in that said housing comprises wall means uniformly spaced from said interior wall and from said curved edge thereof to define said foam pathway to have a substantially constant cross-sectional dimension from said inlet port to said emission opening.

4. Apparatus for applying foamed treating liquor across the width of a traveling substrate according to claim 3 and characterized further in that said wall means includes a pair of side walls disposed on opposite sides of interior wall in parallel relation therewith, each side wall having a curved edge extending adjacent and substantially coextensively and correspondingly with said curved edge of said interior wall, and a curved end wall compatibly curved with said curved edges of said side walls and extending transversely therebetween.

5. Apparatus for applying foamed treating liquor across the width of a traveling substrate according to claim 1 and characterized further in that said curved edge is defined by points located according to the formula $L/2=c+b$, where "L" represents the length of a chord of said interior wall subtending said curved edge parallel to said emission opening and perpendicularly intersecting the axis of said inlet port at the center point of said chord, "c" represents the linear distance of each said point from the center point of said chord, and "b" represents the linear distance of each said point perpendicularly from said chord.

6. Apparatus for applying foamed treating liquor across the width of a traveling substrate according to claim 5 and characterized in that said curved edge is defined by points located according to the formula $b=(L/4)-(a^2/L)$, where "a" represents the distance coordinate of each point measured along said chord from the center point of said chord and "b" represents the distance coordinate of each point perpendicularly from the coordinate "a."

7. Apparatus for applying foamed treating liquor across the width of a travelng substrate according to claim 5 and characterized further in that said housing includes an intersection with said interior wall extending along said chord to prevent said foamed treating liquor entering said distribution chamber through said inlet port from flowing away from said curved edge.

8. Apparatus for applying foamed treating liquor across the width of a traveling substrate according to claim 7 and characterized further in that said emission opening is of an elongate extent substantially equal to the width of said substrate.

9. Apparatus for applying foamed treating liquor across the width of a traveling substrate according to claim 8 and characterized further in that said housing includes an applicator nozzle portion defining said emission opening as a linear slot.

10. Apparatus for applying foamed treating liquor across the width of a traveling substrate according to claim 5 and characterized further in that the length L of said chord of said interior wall is approximately the elongate extent of said emission opening.

11. Apparatus for applying foamed treating liquor across a flat width of traveling substrate, comprising a housing defining a foam distribution chamber therein, a foam inlet tube for communication with a source of said foamed treating liquor, said inlet tube being affixed to said housing and opening therethrough into said distribution chamber for admitting said foamed treating liquor thereinto, an applicator nozzle affixed to said housing and having an elongated foam emission opening in communication with said distribution chamber for foam applying distribution across the width of said substrate, and an interior partition wall disposed in said distribution chamber between said inlet tube and said nozzle, said interior wall having a curved edge to define a turning foam pathway thereabout from said inlet tube to said emission opening, said curved edge being of approximately the elongate extent of said emission opening and being disposed with respect to said inlet tube and said nozzle such that a chord subtending said curved edge extends in substantially parallel relation to said emission opening of said nozzle and in substantially perpendicular intersecting relation to the axis of said inlet tube, said curved edge being of a curvature defining substantially all possible foam flow paths about said curved edge diverging from said inlet tube linearly to said curved edge and linearly the respective shortest distances therefrom to said emission opening to be of substantially the same total length for controlling foam degeneration of said foamed treating liquor to occur uniformly along the length and across the width of said distribution chamber for uniform treatment of said substrate across the width thereof.

12. Apparatus for applying foamed treating liquor across a flat width of traveling substrate according to claim 11 and characterized further in that said housing includes an intersection with said interior wall extending along said chord to prevent said foamed treating liquor entering said distribution chamber through said inlet port from flowing away from said curved edge.

13. Apparatus for applying foamed treating liquor across a flat width of traveling substrate according to claim 12 and characterized further in that said housing includes an applicator nozzle portion defining said emission opening as a linear slot.

14. Apparatus for applying foamed treating liquor across a flat width of traveling substrate according to claim 13 and characterized further in that said housing comprises wall means uniformly spaced from said interior wall and from said curved edge thereof to define said foam pathway to have a substantially constant cross-sectional dimension from said inlet port to said emission opening.

15. Apparatus for applying foamed treating liquor across a flat width of traveling substrate according to claim 14 and characterized further in that said curved edge is defined by points located according to the formula $L/2=c+b$, where "L" represents the length of said chord, "c" represents the linear distance of each said point from the center point of said chord, and "b" represents the linear distance of each said point perpendicularly from said chord.

16. Apparatus for applying foamed treating liquor across a flat width of traveling substrate according to claim 15 and characterized further in that said curved edge is defined by points located according to the formula $b=(L/4)-(a^2/L)$, where "a" represents the distance coordinate of each point measured along said chord from the center point of said chord and "b" represents the distance coordinate of each point perpendicularly from the coordinate "a."

* * * * *